US008038211B2

(12) United States Patent
Berk et al.

(10) Patent No.: US 8,038,211 B2
(45) Date of Patent: Oct. 18, 2011

(54) CHAIR SLIP COVER

(75) Inventors: Michael Berk, Hawthorn Woods, IL (US); Jean Joseph, Oak Park, IL (US)

(73) Assignee: The Howard Elliott Collection, Inc., Carol Stream, IL (US)

( * ) Notice: Subject to any disclaimer, the term of this patent is extended or adjusted under 35 U.S.C. 154(b) by 0 days.

(21) Appl. No.: 12/718,872

(22) Filed: Mar. 5, 2010

(65) Prior Publication Data

US 2011/0215622 A1 Sep. 8, 2011

(51) Int. Cl.
*A47C 31/00* (2006.01)

(52) U.S. Cl. ..... 297/229

(58) Field of Classification Search ..... 297/229, 297/219.1, 225, 228.1, 218.2
See application file for complete search history.

(56) References Cited

U.S. PATENT DOCUMENTS

| | | | | |
|---|---|---|---|---|
| 2,877,832 | A * | 3/1959 | Reavis | 297/228 |
| 3,346,298 | A | 10/1967 | Nancy | |
| D210,014 | S | 1/1968 | Heckthorn | |
| 3,515,430 | A | 6/1970 | Nelson | |
| 3,517,963 | A * | 6/1970 | Woods et al. | 297/228 |
| 3,659,297 | A | 5/1972 | Schultz | |
| D258,187 | S | 2/1981 | Robbins | |
| D312,741 | S | 12/1990 | Treadwell | |
| D349,201 | S | 8/1994 | Sleboda et al. | |
| D366,383 | S | 1/1996 | Briegleb | |
| D377,574 | S | 1/1997 | Mades | |
| 5,816,654 | A | 10/1998 | Ellis | |
| D413,037 | S | 8/1999 | Bellington | |
| D416,430 | S | 11/1999 | Di Genova | |
| D419,025 | S | 1/2000 | Lindberg | |
| 6,079,778 | A | 6/2000 | Lindberg | |
| D473,090 | S | 4/2003 | Trucchi | |
| D491,761 | S | 6/2004 | Nilsen | |
| D504,271 | S | 4/2005 | Springer | |
| D507,144 | S | 7/2005 | Springer | |
| D527,938 | S | 9/2006 | Dandrea | |
| 7,258,399 | B2 * | 8/2007 | Neustat | 297/219.1 |
| D575,976 | S | 9/2008 | Miller | |
| D611,751 | S | 3/2010 | Siklosi | |
| D624,343 | S | 9/2010 | Long | |
| 7,841,658 | B1 | 11/2010 | Marble | |
| 2002/0179212 | A1 | 12/2002 | Willard et al. | |
| 2009/0193616 | A1 | 8/2009 | Hendricks et al. | |
| 2010/0205746 | A1 | 8/2010 | Kerekes et al. | |

OTHER PUBLICATIONS

U.S. Appl. No. 29/357,075, filed Mar. 5, 2010 (which is not being furnished herewith, pursuant to the Commisioner's Notice dated Sep. 21, 2004).

U.S. Appl. No. 29/357,077, filed Mar. 5, 2010 (which is not being furnished herewith, pursuant to the Commisioner's Notice dated Sep. 21, 2004.

(Continued)

*Primary Examiner* — Milton Nelson, Jr.

(74) *Attorney, Agent, or Firm* — James P. Muraff; Neal, Gerber & Eisenberg LLP

(57) ABSTRACT

A seat cover for use with a chair is disclosed herein. The seat cover comprises a fabric cover, which has a back pocket, a seat form and a skirt portion. The seat cover also comprises a back form which has a front pad, a top pad, a first side pad, a second side pad and a first space defined by the front pad, the top pad, the first side pad and the second side pad. The seat cover further comprises a seat pad and a slip barrier.

22 Claims, 4 Drawing Sheets

OTHER PUBLICATIONS

Printout of website http://cdn.overstock.com/images/products/3/L11481882.jpg (dated Apr. 30, 2010).

Printout of website http://www.amazon.com/gp/product/images/B002R3429I/ (dated Apr. 30, 2010).

* cited by examiner

CHAIR SLIP COVER

CROSS-REFERENCE TO RELATED APPLICATIONS

This application is being filed simultaneously with U.S. patent application Ser. No. 29/357,075 filed on Mar. 5, 2010, entitled "Chair Slip Cover" and U.S. patent application Ser. No. 29/357,077 filed on Mar. 5, 2010, entitled "Cushion Insert for Chair Slip Cover", both of which are incorporated herein by reference in their entirety.

TECHNICAL FIELD

The invention relates to a slip cover for covering chairs, and more particularly, for a slip cover with integrated padding elements for covering chairs and adding padding.

BACKGROUND OF THE INVENTION

While the present invention is often described herein with reference to a slip cover for use with a standard chair, an application to which the present invention is advantageously suited, it will be readily apparent that the present invention is not limited to that application and can be employed with chairs with a wide variety of dimensions and styles.

With respect to chairs for use with large banquet halls or large parties, a fundamental problem is present throughout the industry. Due to the large number of chairs associated with these venues or events, owners typically desire chairs that are uniform in design and can be quickly and easily stacked for storage, set-up or take-down, and transportation between the storage location and the venue. However, because of these requirements, the resulting chairs are typically barely, if at all, padded, and are rarely aesthetically pleasing.

One way to make the chairs more pleasing is to use a slip cover for each chair. There are a variety of slip covers for covering chairs that are commercially available in the marketplace. However, few, if any, of these slip covers include a padded section. Instead, these covers are used solely for aesthetics and rely on any padding that is integral with the existing chair to provide comfort for any potential user.

Moreover, these slip covers typically involve complicated, time-consuming arrangements to connect them to the chairs, such as tying strings around each leg and the back of the chair. This is not desirable because, as stated above, the ability to rapidly set-up and remove these chairs is important to the owners and/or service providers.

The foregoing indicates that there is a significant market potential for the use of slip covers with chairs that are able to be easily and rapidly set-up, taken down and/or stored, but also results in a padded chair that is aesthetically pleasing.

SUMMARY OF THE INVENTION

One embodiment of the present invention is directed to a slip cover that is used with an industry standard chair. The chair is typically used with large parties or in large banquet halls, and thus can be easily and rapidly stacked with the numerous other chairs for ease of storage and transport. The slip cover has an integral padding, and can be easily placed on the chair, removed from the chair and/or stored. The shape of the slip cover also cooperates with holders to prevent inadvertent removal of the slip cover from the chair.

BRIEF DESCRIPTION OF THE DRAWINGS

To understand the present invention, it will now be described by way of example, with reference to the accompanying drawings in which.

DETAILED DESCRIPTION

Figure 1:
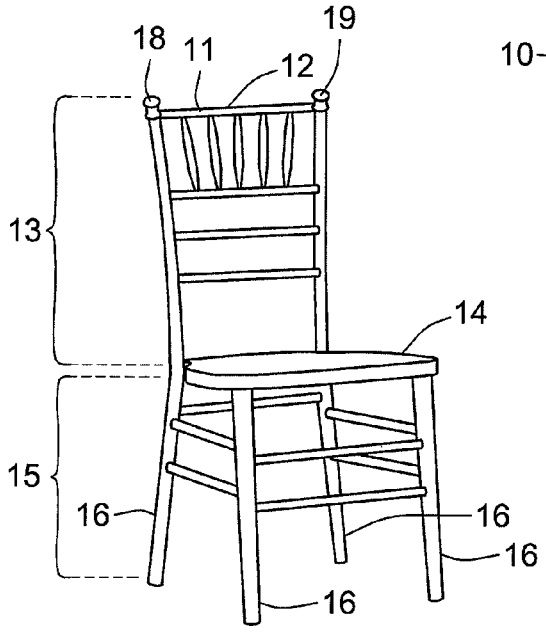
FIG. 1 depicts an exemplary chair used with a first embodiment of the invention disclosed herein.
Figure 2:
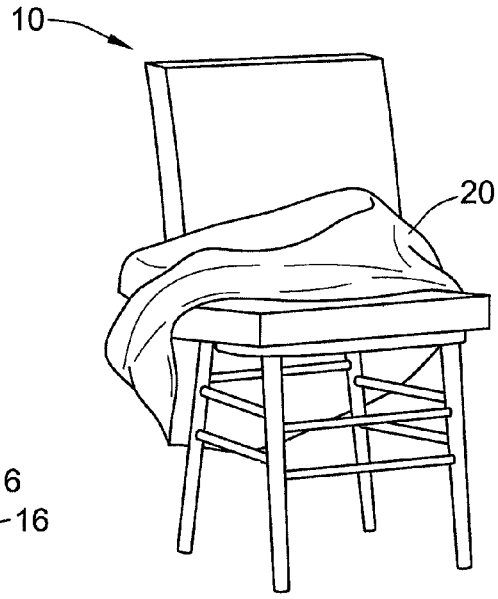
FIG. 2 depicts the first embodiment of FIG. 1, with the slip cover assembly partially covering the chair.
Figure 3:
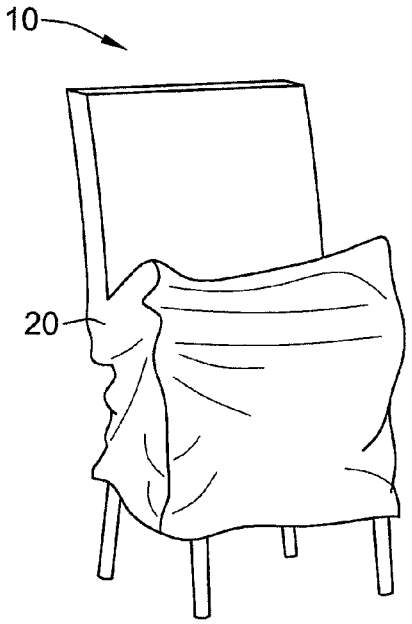
FIG. 3 depicts the first embodiment of FIG. 1, with the slip cover assembly almost completely covering the chair.
Figure 4:
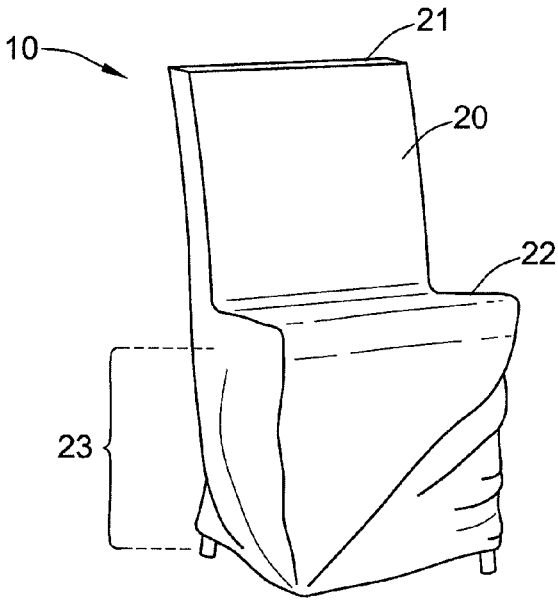
FIG. 4 depicts the first embodiment of FIG. 1, with the slip cover assembly covering the chair.
Figure 5:
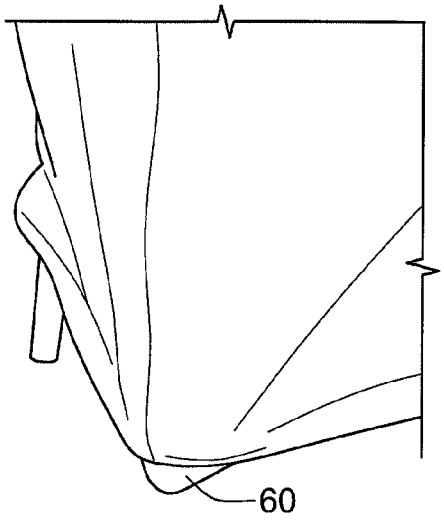
FIG. 5 is a close up view of FIG. 1, depicting the holder engaging a leg of the chair.
Figure 6:
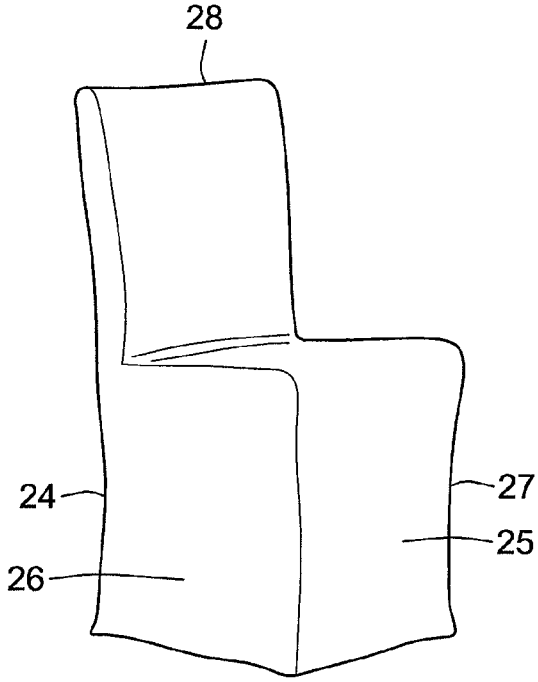
FIG. 6 depicts the first embodiment of FIG. 1, with the slip cover assembly completely covering the chair.
Figure 7:
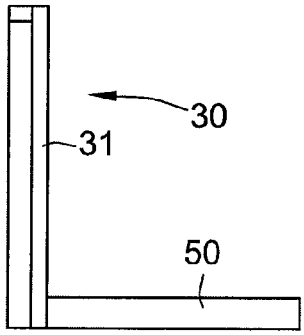
FIG. 7 depicts a side view of a first embodiment of the back padding element and the seat padding element.
Figure 8:
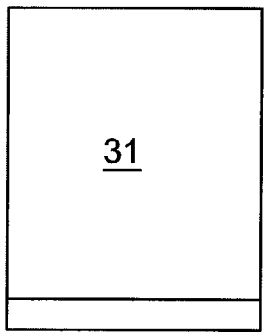
FIG. 8 depicts a front view of the first embodiment shown in FIG. 7.
Figure 11:
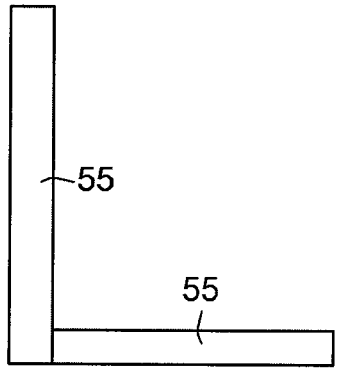
FIG. 11 depicts a side view of a first embodiment of the slip barrier.

While this invention is susceptible of embodiments in many different forms, there is shown in the drawings and will herein be described in detail embodiments of the invention with the understanding that the present disclosure is to be considered as an exemplification of the principles of the invention and is not intended to limit the broad aspect of the invention to the embodiments illustrated.

FIGS. 1-14 depict the slip cover assembly 10 of one embodiment of the present invention as well as a typical chair 12 that may be used with this embodiment. As seen, chair 12 comprises a back structure 13, a seat structure 14 and a leg structure 15. The leg structure of the depicted chair 12 comprises four legs 16, but may include any number of support means, such as a single pedestal, or a combination of legs and pedestals.

In the depicted embodiment, slip cover assembly 10 comprises fabric cover 20, which includes back pocket 21, seat portion 22 and skirt portion 23. Fabric cover 20 comprises polyurethane, but could also comprise vinyl for a weather-resistant functionality. As seen, when slip cover assembly 10 is placed over chair 12, back structure 13 is located within back pocket 21, seat structure 14 is located proximate to seat portion 22, and leg structure 15 is located within skirt portion 23.

Skirt portion 23 comprises first wall 24, which extends generally perpendicular to seat portion 22, second wall 25, which is formed opposite first wall 24, third wall 26, which extends generally perpendicular to seat portion 22 and is generally perpendicular to first wall 24 and second wall 24, and fourth wall 27, which extends generally perpendicular to seat portion 22 and is formed opposite third wall 26.

A plurality of holders 60 is formed on skirt portion 23. As seen, for example, in FIG. 5, holders 60 comprise cloth bands that are engaged to two adjacent walls of skirt portion 23. However, any number of easy to use structures may be employed for the holders, such as elastic bands. When slip cover assembly 10 is placed over chair 12, each holder 60 engages its respective leg 16, to prevent the inadvertent removal of slip cover assembly 10 from chair 12.

Additionally, the differences in dimensions between fabric cover 20 and chair 12 are very minimal. By way of example, fabric cover 20 has an elastic quality, such that, once it is placed over chair 12, skirt portion 23 abuts the entire length of each leg 16. In this way, skirt portion 23 has a slightly curved profile, as seen, for example, in FIG. 6, that mimics the overall envelope of leg structure 15. As a result, once slip cover assembly 10 is placed over chair 12, fabric cover 20 has a taut appearance, and looks to be a solid piece, rather than merely fabric draped over a chair. Additionally, this tautness aids in preventing slip cover assembly 10 from being inadvertently removed from chair 12.

Slip cover assembly 10 further comprises back padding element 30, which comprises front pad 31, a first side pad 32, a second side pad 33, top spacer 34 and top boarder 35. As seen, first side pad 32 is engaged to front pad 31 proximate to first edge 36 and second side pad 33 is engaged to front pad 31 proximate to second edge 37 of front pad 31. Likewise, top border 35 is engaged to front pad 31 proximate to third edge 38. While each element of back padding element 30 is depicted as separate and removable from front pad 31, it will be understood that the scope of the present invention includes those embodiments in which each element of back padding element 30 is integrally formed from front pad 31.

Figure 9:
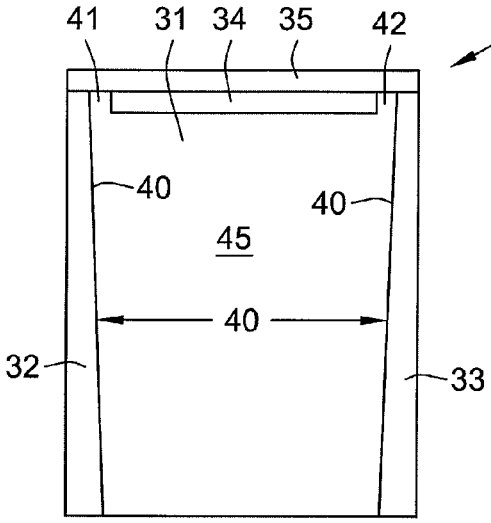
FIG. 9 depicts a back view of the first embodiment of the back padding element shown in FIG. 7.
Figure 10:
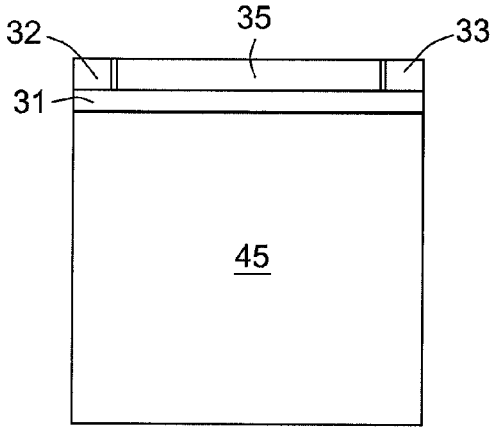
FIG. 10 depicts a bottom view of the first embodiment shown in FIG. 7.
Figure 12:
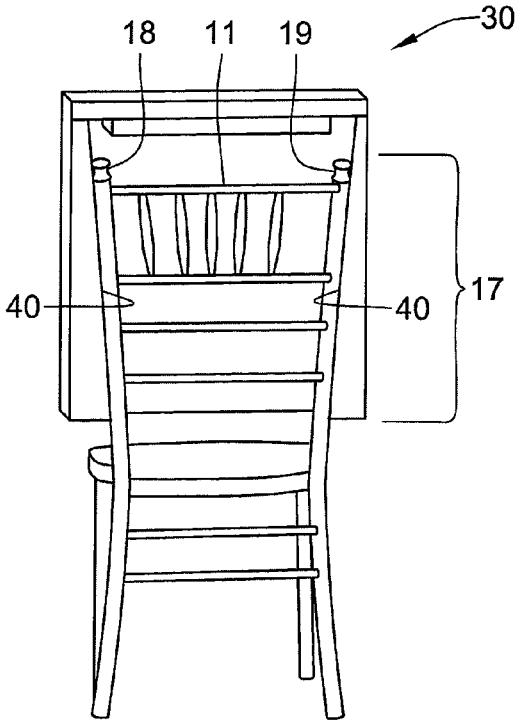
FIG. 12 depicts a back view of the back padding element of FIG. 7 being slid over the chair of FIG. 1.
Figure 13:
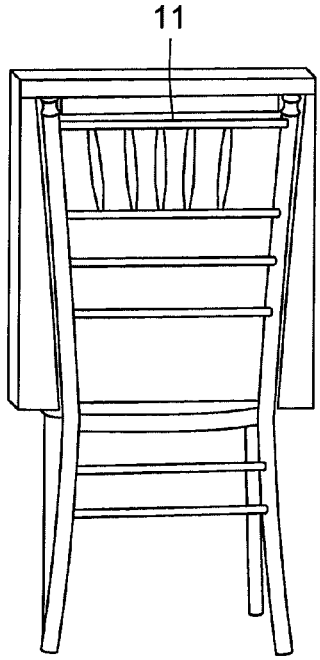
FIG. 13 depicts the back view of FIG. 12, with the back padding element completely slid over the chair.
Figure 14:
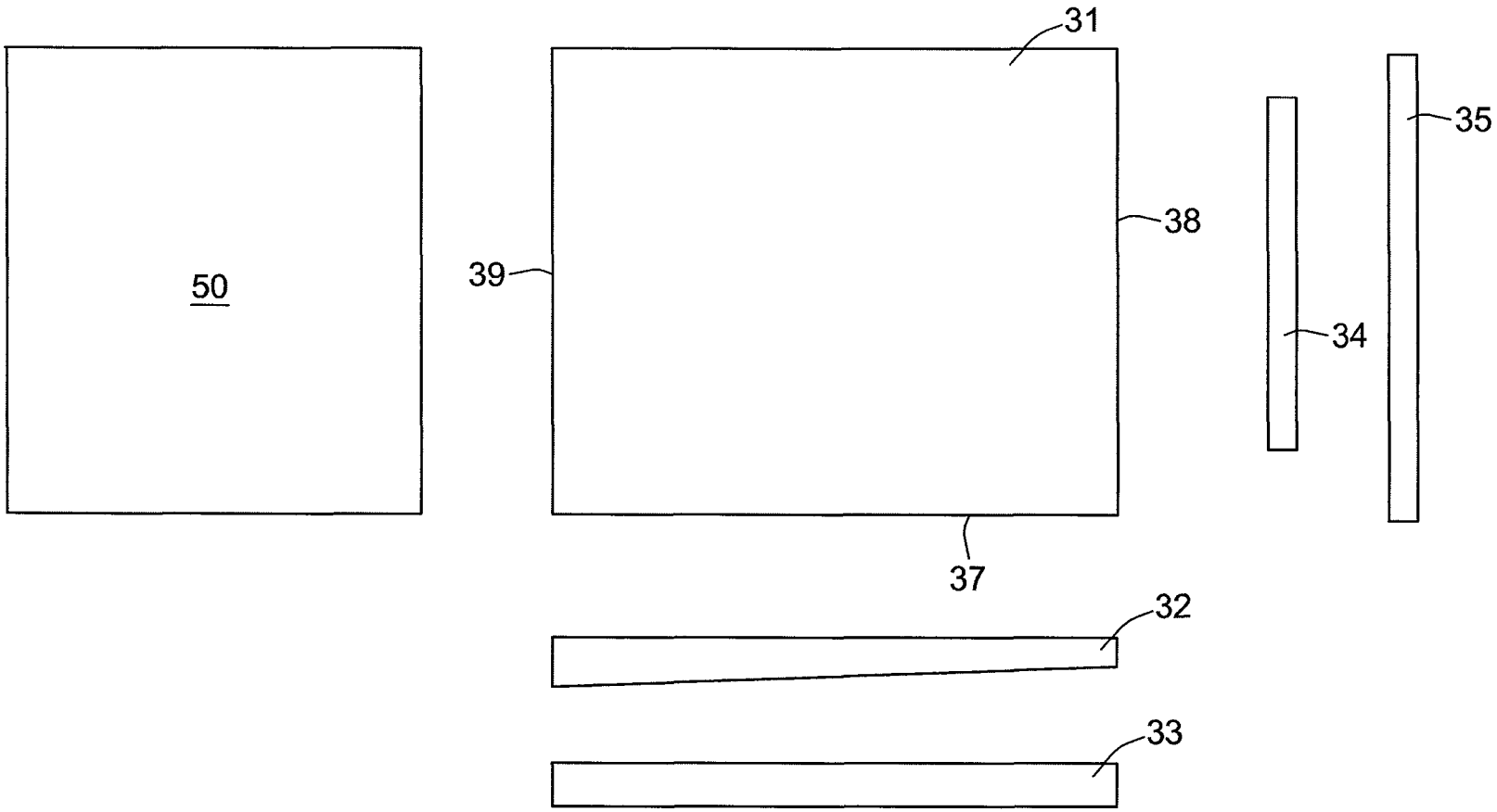
FIG. 14 depicts the elements of the first embodiment of the back padding element disengaged.

As seen in FIG. 9, for example, each side pad 32 and 33 comprises a tapered edge 40. In this manner, a back structure 13 that comprises a tapered frame, such as frame 17, depicted in FIG. 12, can be accommodated by back padding element 30. Specifically, the tapered edge 40 engages frame 17 along the entire length, allowing side pads 32 and 33 to be supported along the entire tapered edge 40.

The location of top spacer 34, top boarder 35 and each side pad 32 and 33 defines knob cavities 41 and 42. When slip cover assembly 10 is placed over chair 12, knobs 18 and 19 are located in knob cavities 41 and 42, respectively. In this manner, top boarder 35 is supported by each knob 18 and 19. Additionally, because top spacer 34, is located proximate to cross bar 11 of chair 12, top boarder 35 is likewise supported, through top spacer 34, by cross bar 11. Because of this, top boarder 35 is supported across its entire length, which results in an even, straight appearance across the top 28 of slip cover assembly 10, rather than an appearance in which top 28 sags in the middle. Finally, while top spacer 34 and top boarder 35 are depicted as separate elements, it will be understood that the scope of the present invention includes those embodiments in which top spacer 34 is integrally formed from top boarder 35.

Front pad 31, each side pad 32 and 33 and top boarder 35 define back cavity 45. When slip cover assembly 10 is placed over chair 12, back structure 13 is located within back cavity 45, and abuts front pad 31 on one side of back structure 13, and fabric cover 20 on the opposite side of back structure 13. However, it will be appreciated that the scope of the present invention includes those embodiments in which back structure 13 does not directly abut fabric cover 20 on the side opposite from front pad 31, but rather has an extra element, such as an additional pad, positioned between fabric cover 20 and back structure 13.

Slip cover assembly 10 further comprises seat padding element 50, which is engaged to front pad 31 proximate to fourth edge 39 of front pad 31. When slip cover assembly 10 is placed over chair 12, seat padding element 50 rests on seat structure 14.

Some or all of seat padding element 50 and back padding element 30 may be encased in slip barrier 55, which may comprise a 100% non-woven polyester fabric. Additionally, slip barrier 55 hingedly engages seat padding element 50 with front pad 31. The non-woven polyester fabric is inexpensive, flame resistant and provides a slippery surface that aids a user in putting slip cover assembly on chair 12. As such, slip barrier 55 is located on any surface of seat padding element 50 and back padding element 30 that may come into contact with chair 12 when slip cover assembly 10 is placed over chair 12.

Seat padding element 50 and each element of back padding element 30 comprises a polyurethane foam. Typically, polyurethane foams have two metrics used to determine the functionality of the foam. The first, foam density, is a function of the chemistry used to produce the foam. Flexible polyurethane foam is available in a broad range of densities, ranging from as low as 0.8 pounds per cubic foot to as high as 6 pounds per cubic foot.

The second metric typically used is the support factor, which is a function of the firmness of a foam. The firmness of a foam is a measurement of the surface feel of the foam. The support factor is determined by measuring the firmness (IFD) of the foam by compressing it 25% of its original height, and then measuring the IFD when compressing the same foam sample 65% of its original height. The ratio of the 65% IFD divided by the 25% IFD is the foam's support factor.

In the depicted embodiment, the polyurethane foam has a density of density of 1.5 pounds per cubic foot, but may be anywhere in the range of 1.0 to 2.3 pounds per cubic foot. The depicted embodiment comprises a support factor of 2.0 or above, but may be anywhere in the range of 2.0 to 7.0. It will be appreciated by those in the art that the scope of the present invention includes those embodiments in which one or both of seat padding element 50 and back padding element 30 comprise materials that are different from the polyurethane foam, but have similar support factors.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

The invention claimed is:

1. A seat cover for use with a chair having a back structure, a seat structure and a leg structure, the seat cover comprising:

a fabric cover for covering the chair, the fabric cover comprising a back pocket, a seat form and a skirt portion;

a back form positioned in the back pocket, the back form comprising a front pad, a top pad engaged to the front pad proximate to a first edge of the front pad, a first side pad engaged to the front pad proximate to a second edge of the front pad, a second side pad engaged to the front pad proximate to a third edge, opposite the second edge, of the front pad, and a first space defined by the front pad, the top pad, the first side pad and the second side pad;

a seat pad positioned proximate to the seat form of the fabric cover and engaged to the back form proximate to a fourth edge, opposite to the first edge, of the front pad; and a slip barrier engaged to at least some of a surface of the back form and the seat pad.

2. The seat cover as set forth in claim 1, wherein the seat pad is hingedly connected to the back form.

3. The seat cover as set forth in claim 2, wherein the seat pad is hingedly connected to the back form through the slip barrier.

4. The seat cover as set forth in claim 1, wherein the seat pad comprises a polyurethane foam having a density of 1.5 pounds per cubic foot and a support factor of 2.0 or above.

5. The seat cover as set forth in claim 4, wherein the seat pad is two inches thick.

6. The seat cover as set forth in claim 1, wherein the back form comprises a polyurethane foam having a density of 1.5 pounds per cubic foot and a support factor of 2.0 or above.

7. The seat cover as set forth in claim 6, wherein the front pad is one inch thick.

8. The seat cover as set forth in claim 1, wherein the top pad comprises a first top pad comprising a first length, and a second top pad comprising a second length that is shorter than the first length.

9. The seat cover as set forth in claim 8, further comprising a first knob cavity defined by the first top pad, the second top pad and the first side pad, and a second knob cavity defined by the first top pad, the second top pad and the second side pad.

10. The seat cover as set forth in claim 1, further comprising a plurality of holders formed on the skirt portion, wherein the plurality of holders engage the leg structure to prevent inadvertent removal of the seat cover from the chair.

11. An assembly for covering a chair having a back structure, a seat structure and a support structure, the assembly comprising:

a fabric cover comprising a back portion, a seat portion and a skirt portion;

a plurality of holders on the skirt portion, wherein the plurality of holders engage the support structure to prevent inadvertent removal of the assembly when the assembly is covering a chair;

a back padding portion positioned in the back portion of the fabric cover and comprising a front pad, a top pad engaged to the front pad, a first side pad engaged to the front pad and a second side pad engaged to the front pad;

a back structure pocket defined by the back portion of the fabric cover, the first side pad, the second side pad, the top pad and front pad, wherein the back structure is located in the back structure pocket when the assembly covers the chair;

a seat padding portion positioned proximate the seat portion of the fabric cover and engaged to the front pad; and a slip barrier engaged to the seat padding portion, the top pad, the first side pad, the second side pad and the front pad.

12. The assembly as set forth in claim 11, wherein the seat padding portion is hingedly engaged to the front pad.

13. The assembly as set forth in claim 12, wherein the seat padding portion is hingedly engaged to the front pad through the fabric.

14. The assembly as set forth in claim 11, wherein the skirt portion comprises a first wall extending generally perpendicular to the seat portion, a second wall formed opposite the first wall, a third wall extending generally perpendicular to the seat portion and formed generally perpendicular to the first and second walls, and a fourth wall extending generally perpendicular to the seat portion and formed opposite the third wall.

15. The assembly as set forth in claim 14, wherein the plurality of holders comprise a plurality of cloth strips.

16. The assembly as set forth in claim 15, wherein at least one cloth strip is positioned at each corner of the skirt portion.

17. The assembly as set forth in claim 11, wherein the fabric cover comprises a polyurethane material.

18. The assembly as set forth in claim 11, wherein, when the assembly covers a chair, differences between at least some of the dimensions of the fabric cover and the chair result in a tight fit between the fabric cover and the chair that aids in preventing the inadvertent removal of the assembly from the chair.

19. The assembly as set forth in claim 11, wherein the seat padding portion comprises a polyurethane foam having a density of 1.5 pounds per cubic foot and a support factor of 2.0 or above.

20. The assembly as set forth in claim 11, wherein the slip barrier comprises a 100% polyester nonwoven fabric.

21. The assembly as set forth in claim 20, wherein the slip barrier is located on a surface of the front pad, the first and second side pads, the top pad and the seat padding portion that is engaged to a chair.

22. The assembly as set forth in claim 11, wherein the front pad comprises a polyurethane foam having a density of 1.5 pounds per cubic foot and a support factor of 2.0 or above.

* * * * *